United States Patent [19]

Kronenwetter et al.

[11] 4,402,737

[45] Sep. 6, 1983

[54] METHOD OF PRODUCING TUNGSTEN AND TUNGSTEN CARBIDE POWDER

[75] Inventors: Christopher A. Kronenwetter, Towanda; Geoffrey L. Harris, Monroeton; Edward R. Kimmel, Sayer, all of Pa.

[73] Assignee: GTE Products Corporation, Stamford, Conn.

[21] Appl. No.: 413,906

[22] Filed: Sep. 1, 1982

[51] Int. Cl.[3] ..... B22F 9/00

[52] U.S. Cl. ..... 75/0.5 BB; 75/0.5 BC; 423/440; 419/18; 419/31

[58] Field of Search ..... 75/0.5 BB, 0.5 BC, 203, 75/211; 423/440

[56] References Cited

U.S. PATENT DOCUMENTS

| | | | |
|---|---|---|---|
| 3,713,789 | 1/1973 | Ramquist | 75/0.5 BB |
| 3,773,493 | 11/1973 | Brecher et al. | 75/0.5 BB |
| 3,850,614 | 11/1974 | Bleecker | 75/0.5 BB |
| 4,101,309 | 7/1978 | Koseki et al. | 75/0.5 BB |

*Primary Examiner*—W. Stallard

*Attorney, Agent, or Firm*—Robert E. Walter

[57] ABSTRACT

A uniform, large size tungsten powder having properties which make it suitable for producing large size tungsten carbide powder is produced by doping a tungsten oxide starting powder with a lithium compound prior to reduction

11 Claims, No Drawings

METHOD OF PRODUCING TUNGSTEN AND TUNGSTEN CARBIDE POWDER

The invention is directed to the production of tungsten and tungsten carbide in powder form. More particularly, this invention is directed to the production of tungsten and tungsten carbide powder of coarse particle size.

There are generally two forms of tungsten carbide. Monotungsten carbide has the formula WC, and ditungsten carbide has the formula $W_2C$. Of the two, WC is more applicable for use in the manufacture of many objects such as, without limitation, dies and cutting and drilling tools. In producing such dies and tools, the WC form of tungsten carbide powder may be combined with a bonding agent such as cobalt and sintered together to form what is known in the art as a cemented carbide structure.

In certain applications it would be desirable to produce tools from WC powder particles which comprise a polycrystalline structure of coarse grains or crystals. This is particularly true regarding many mining and drilling tools.

U.S. Pat. No. 2,113,171 to Cooper describes one process for producing the WC form of tungsten carbide powder. In this process, very fine powdered tungsten is mixed with very fine powdered carbon such as lampblack. The mixture is thoroughly blended and the powder is heated in a hydrogen atmosphere for thirty to forty-five minutes at about 1200° C. to 1600° C. The preferred temperature is 1400° C.

A similar patent of interest is U.S. Pat. No. 3,850,614 to Bleecker which describes the production of WC by carburizing pure tungsten powder and pure carbon black at 2750° F. or about 1340° C.

It is believed that the process generally used in producing WC for use in cutting and mining tools is of the type described in Cooper involving temperatures of about 1200° C. to about 1600° C. For example, the process of Bleecker falls within this range and produces WC for use in the production of extremely fine powder in 1.1 to 1.3 micron range. In addition, particles having finer grain sizes are not particularly mechanically stable and are therefore subjected to a greater degree of attrition during milling than desired.

SUMMARY OF THE INVENTION

There has been a continuing need for a cemented carbide composed of large, uniform grains for use in mining bits. Typically, coarse grained cemented carbide is made from coarse grained tungsten carbide which, in turn, is made from tungsten metal powder having a large particle size.

A uniform, large size tungsten powder having metallurgical properties which make it suitable for the production of large size tungsten carbide powder is produced by doping a tungsten oxide starting powder with a lithium compound prior to reduction. The lithium compound is a high melting lithium compound which decomposes during the hydrogen gas reduction step to yield a large size tungsten powder having a very low level of lithium.

To produce coarse grain tungsten carbide, the large grain size tungsten powder is intimately mixed with carbon powder in amounts allowing for at least one atom of carbon for each atom of tungsten. Such mixture is heated to a temperature falling within the range of about 1300° C. to any temperature less than that which will melt tungsten carbide and such heating is continued for a time sufficient to carburize the tungsten powder to tungsten carbide. Such monotungsten carbide is then cooled for further processing.

The invention also relates to a monotungsten carbide object and method of producing same. To produce such an object tungsten carbide powder is produced in the manner described in the immediately preceeding paragraph. The cooled tungsten carbide powder is mixed with a binding agent such as, for example, cobalt. The binding agent may include a hydrocarbon solvent such as heptane and a lubricant such as paraffin wax. Subsequently, the binding agent/monotungsten carbide mixture is pressed into a predetermined formed object which is sintered.

DETAILED DESCRIPTION

In the preparation of tungsten powder from tungsten oxide, in accordance with the present invention, a tungsten oxide starting powder is doped with a lithium compound prior to reduction.

Pure tungsten oxide starting powder is typically prepared by methods known in the art from ammonium paratungstate which is reduced in a rotary kiln to form a blue or yellow tungsten oxide.

The tungsten oxide starting powder is typically of high purity and consist essentially of tungsten oxide with less than about one percent by weight other minor ingredients in the form of impurities or additives. Such minor ingredients may comprise aluminum, calcium, copper, iron, chromium, magnesium, manganese, nickel, silicon, tin, sodium, potassium and molybdenum. Preferably the minor ingredients are present in an amount less than about 0.5 percent by weight.

The dopant preferably comprises a high melting lithium compound which decomposes at the reduction temperature so that substantially all of the dopant initially present is removed. Typical high melting lithium compounds are lithium chloride, lithium bromide, lithium fluoride and lithium carbonate. The dopant may be added directly to the tungsten oxide starting powder directly and intimately mixed therewith so as to form a uniform blend. Preferably the lithium compound is water soluble, such as lithium chloride, and is intimately mixed with the starting tungsten oxide in the form of a solution. Preferably the dopant is present in the starting tungsten oxide in an effective amount to give tungsten powder of increased particle size as compared to undoped tungsten oxide. Based on parts per million lithum, the dopant is preferably present in an amount less than 1000 ppm. The preferable range of doping is from about 50 to about 500 ppm.

The starting tungsten oxide and dopant mixture is preferably reduced at a temperature above the decomposition or melting temperature of the dopant to remove substantially all of the dopant and form a tungsten powder, preferably to levels of less than about 100 parts per million lithium. Due to the hereinbefore mentioned purity of the tungsten oxide starting powder, the resulting tungsten powder is of high purity.

The tungsten powder produced has a large and uniform Fisher Sub Sieve Size (FSSS) as compared to tungsten powders prepared without any dopant or prepared with other alkali metal compound dopants such as potassium or sodium salts. As the level of lithium doping increases, the FSSS of the resulting tungsten powder increases. It is generally not desirable to dope with lithium above the 2000 per million level since it is more difficult to remove the lithium and the product tungsten powder may become contaminated with undesirable levels of lithium. The tungsten powder preferably has an average particle size of from about 25 to about 100 microns.

To produce monotungsten carbide comprising WC particles having coarse grain size, the above produced tungsten powder is intimately mixed with carbon powder in amounts allowing for at least one atom of carbon for each atom of tungsten. The carbon powder is of a high purity and may be, for example, carbon black, although other known carbon powders may be used. It has been found that small amounts of cobalt metal powder added prior to mixing beneficially to catalyze the carburization reaction. Typically the cobalt is added in a catalytic amount such as from about 0.1 to about 0.5 percent by weight. In mixing tungsten it has been found that ball milling is particularly suitable for this purpose although any other mixing means may be used which will facilitate obtaining the intimate mixture desired.

After the mixing step the powder mixture of tungsten and carbon is loaded in graphite boats or crucibles and fed to a furnace for heating. A resistance furnace such as, for example, a tube furnace has bee found to be particularly suitable for heating although any furnace which will allow for heating to the desired temperature may be used. The powder mixture is heated to a temperature falling within a range of about 1300° C. to any temperature less than that which will melt monotungsten carbide, and such heating is continued for a time sufficient to carburize the tungsten (W) powder to monotungsten carbide (WC). Although it is stated that the top of the heating range is any temperature less than that which will melt monotungsten carbide, it is generally believed that tungsten carbide melts at about 2600° C. to about 2880° C. In the preferred embodiment heating occurs in a reducing atmosphere which is preferably hydrogen and in the absence of a vacuum.

After the boats have ben moved through the furnace the monotungsten carbide is cooled and screened to remove excessively coarse agglomerates. Such screening may be through, for example, 100 mesh.

In producing a monotungsten carbide object, monotungsten carbide powder is first produced as described above. After screening, a binding agent is mixed with the cooled monotungsten carbide powder. In the preferred embodiment the binding agent comprises cobalt. One preferred mixture comprises about 90% by weight monotungsten carbide and about 10% by weight cobalt. When the cobalt is mixed with the monotungsten carbide, a hydrocarbon solvent such as heptane and a lubricant such as parafin wax may be added, the combined mixture being milled in an attritor mill. Subsequently, heat is applied to the mixture to evaporate the heptane. The remaining binding agent/monotungsten carbide mixture is pressed into a predetermined formed object which is sintered.

The process and product of this invention is more particularly explained in the following examples which are illustrative only. Those skilled in the art will recognize that there are numerous modifications and variations and that the present invention is not limited to such examples.

EXAMPLE

Two kilograms of oxide were charged to a small lab V-blender. An appropriate amount of NaCl, KCl, or LiCl was dissolved in deionized water (see Table I). No more water was used than was needed to completely dissolve the chloride crystals. The dopant solution was sprinkled over the oxide. The charge was then blended for 10 minutes with the intensifier bar working.

Three boatloads of each oxide blend were reduced in the reduction furnaces at the following conditions:

Temperature—1150° C.

Time—5 hours $H_2$ Flow—12.5 cfh

Boatload—11×Bulk Density (g/in$^3$)

Boatload was based on bulk density rather than weight to insure a more uniform bed depth (about one inch). Inconel boats approximately 8.5" long were used for reduction. After being pulled from the furnace, each boat was screened 40 mesh.

Table I shows the resulting Na, K, and Li content of the oxide blends after doping. All of the blends were ±11% of the desired amount. Table III contains physical data on the individual boatloads of tungsten metal powder and on the blends of powder made from each oxide type. Note that the powder reduced from the Li-doped oxide exhibited much higher FSSS's than the powder reduced from the Na-doped oxides. In turn, the Na-doped oxide produced powder of much high FSSS than did the K-doped oxide. The residual Li depended on the doping level. This is seen in Table V. About one kilogram of the tungsten, carbon and cobalt mixture was loaded in a graphite reduction boat and fed to a tube furnace in which the tungsten was carburized to to montungsten carbide. The cobalt powder was added in an amount of 0.2% by weight to catalize the reaction as hereinbefore discussed. Heating was at 1550° C. for 4 hours in a reducing atmosphere of hydrogen. The monotungsten carbide was cooled and was screened through 100 mesh. Subsequently, 315 grams of the monotungsten carbide so produced was blended and milled with 35 grams of cobalt, 180 milliliters of heptane and 7 grams of parafin for 45 minutes at 350 R.P.M. in an attritor mill. The resulting mix was steam dried to remove the heptane, pressed at 10 tons per square inch into standard C.C.P.A. test bars and sintered at 1435° C. A cemented carbide having uniform properties and a coarse wc grain size resulted.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

TABLE I

| | Oxide Analysis | | | | | |
|---|---|---|---|---|---|---|
| | | Bulk | | | | |
| | FSSS | Density | grams of Dopant | Resulting | | |
| Oxide Blend | μ | G/in$^3$ | Added | Na | K | Li |
| $WO_3$ + 100Na | 18.2 | 49.22 | .508 NaCl | 96 | <10 | — |
| $WO_3$ + 500Na | 18.1 | 48.44 | 2.542 NaCl | 450 | <10 | — |
| $WO_3$ + 100K | 18.8 | 49.16 | .381 KCl | <5 | 92 | — |
| $WO_3$ + 500K | 18.0 | 48.90 | 1.907 KCl | <5 | 480 | — |
| $WO_3$ + 100Li | 19.6 | 46.09 | 1.222 LiCl | 5 | <10 | 100 |
| $WO_3$ + 500Li | 20.0 | 44.34 | 6.109 LiCl | <5 | <10 | 460 |
| $WO_3$ Control | 15.4 | 53.88 | — | <5 | <10 | — |

TABLE III

| | | WMP Physical Data | | | | | | | |
|---|---|---|---|---|---|---|---|---|---|
| | | BOAT FSSS's | | | | | BLEND | | |
| Oxide Type | Boatload | 1st,μ | 2nd,μ | 3rd,μ | Avg. μ | S.D. μ | FSSS μ | RMF,μ | Bulk Density g/in$^3$ |
| $WO_3$ + 100Na | 540g | 17.5 | 16.4 | 16.0 | 16.6 | .78 | 16.0 | 11.0 | 71.34 |
| $WO_3$ + 500Na | 530 | 34.0 | 33.6 | 35.0 | 34.2 | .72 | 39.0 | 23.0 | 105.62 |
| $WO_3$ + 100K | 540 | 10.0 | 9.80 | 10.4 | 10.1 | .31 | 9.80 | 7.80 | 64.70 |
| $WO_3$ + 500K | 535 | 14.5 | 16.4 | 16.3 | 15.7 | 1.07 | 15.7 | 10.4 | 76.96 |
| $WO_3$ + 100Li | 500 | 37.4 | 35.0 | 36.0 | 36.1 | 1.21 | 42.0 | 22.0 | 106.80 |
| $WO_3$ + 500 | 485 | +50 | +50 | +50 | +50 | — | +50 | 35.0 | 105.76 |
| $WO_3$ Control | 590 | 8.50 | 8.70 | 8.70 | 8.6 | .12 | 8.70 | 6.06 | 66.16 |

TABLE V

| | Residual Alkali and Sedigraph Data For the WMP | | | | | | | |
|---|---|---|---|---|---|---|---|---|
| | RESIDUAL | | | SEDIGRAPH | | | | |
| Oxide Type | Na ppm | K ppm | Li ppm | Mean | % <5 μm | % <10 μm | % <20 μm | % <50 μm |
| $WO_3$ + 100Na | <5 | <10 | <5 | 9.22 | 17.0 | 60.5 | 98.6 | 100 |
| $WO_3$ + 500Na | 14 | <10 | <5 | 16.94 | 4.5 | 29.0 | 71.5 | 98.0 |
| $WO_3$ + 100K | <5 | <10 | <5 | 7.59 | 25.5 | 78.7 | 99.0 | 100 |
| $WO_3$ + 500K | <5 | <10 | <5 | 9.03 | 16.0 | 64.0 | 98.7 | 100 |
| $WO_3$ + 100Li | <5 | <10 | 20 | 18.83 | 1.0 | 26.8 | 69.5 | 95.0 |
| $WO_3$ + 500:o | <5 | <10 | 29 | 66.01 | 0.0 | 0.5 | 4.5 | 34.0 |
| $WO_3$ Control | <5 | <10 | <5 | 6.88 | 35.0 | 81.5 | 99.0 | 100 |

We claim:

1. A method of producing large size tungsten powder from tungsten oxide comprising doping a tungsten oxide powder with a high melting lithium compound, and reducing said tungsten oxide powder with hydrogen gas at a temperature higher than the decomposition or melting temperature of the lithium compound for a sufficient period of time to convert substantially all of said tungsten oxide powder to tungsten powder, said lithium compound being present in an amount sufficient to result in a tungsten powder after reduction having increased particle size as compared to tungsten powder reduced without said dopant.

2. A method according to claim 1 wherein said tungsten oxide powder consists essentially of tungsten oxide, less than about 1000 parts per million of lithium, and less than about 0.5 percent by weight other minor ingredients.

3. A method according to claim 2 wherein said lithium is present in an amount from about 50 to about 500 parts per million.

4. A method according to claim 3 wherein said lithium is present in said tungsten powder in an amount less than 100 parts per million.

5. A method of producing tungsten powder from tungsten oxide comprising uniformly doping a tungsten oxide powder with less than about 2000 parts per million of lithium, said lithium being present as a high melting lithium compound, and reducing said doped tungsten oxide powder with hydrogen to form tungsten metal powder.

6. A method according to claim 5 wherein said lithium is present in an amount less than 1000 parts per million.

7. A method according to claim 6 wherein said tungsten oxide powder consist essentially of tungsten oxide, less than 1000 parts per million lithium and less than about 0.5 percent by weight other minor ingredients.

8. A method for producing monotungstsen carbide comprising form tungsten oxide comprising doping a tungsten oxide powder with from about 50 to about 1000 parts per million of lithium wherein said lithium is present as a high melting lithium compound, reducing said doped tungsten oxide powder with hydrogen to form tungsten metal powder, intimately mixing tungsten powder and carbon powder in amounts allowing for at least one atom of carbon for each atom of tungsten, heating said mixture to a temperature within a range of about 1300° C. to any temperature less than that which will melt monotungsten carbide, continuing said heating for a time sufficient to carburize said powders to monotungsten carbide, and cooling said monotungsten carbide.

9. A method according to claim 8 wherein a catalytic amount of cobalt metal powder is mixed with said tungsten powder prior to carburizing.

10. A method according to claim 8 wherein said reducing step is at a temperature greater than the decomposition or melting temperature of said lithium compound whereby said tungsten powder has less than about 100 parts per million lithium.

11. A method of producing a cemented carbide comprising doping a tungsten oxide powder with a high melting lithium compound, and reducing said tungsten oxide powder with hydrogen gas at a temperature higher than the decomposition or melting temperature of the lithium compound for a sufficient period of time to convert substantially all of said tungsten oxide powder to tungsten powder, intimately mixing said tungsten powder and carbon powder in amounts allowing for at least one atom of carbon for each atom of tungsten, heating said mixture to a temperature within a range of 1300° C. to any temperature less than that which will melt monotungsten carbide, continuing said heating for a time sufficient to carburize said powders to monotungsten carbide, mixing said monotungsten carbide powder with a metal binder powder to form a resulting powder, pressing and sintering said resulting powder to form a cemented carbide.

* * * * *